US011525325B2

(12) United States Patent
Fripp et al.

(10) Patent No.: US 11,525,325 B2
(45) Date of Patent: Dec. 13, 2022

(54) ONE PIECE FRAC PLUG

(71) Applicant: Halliburton Energy Services, Inc., Houston, TX (US)

(72) Inventors: Michael Linley Fripp, Carrollton, TX (US); Zachary William Walton, Edmond, OK (US); Haoyue Zhang, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/072,377

(22) Filed: Oct. 16, 2020

(65) Prior Publication Data

US 2021/0164315 A1 Jun. 3, 2021

Related U.S. Application Data

(60) Provisional application No. 62/942,820, filed on Dec. 3, 2019.

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01)

(58) Field of Classification Search
CPC ..... E21B 33/1208; E21B 23/06; E21B 34/142
See application file for complete search history.

(56) References Cited

U.S. PATENT DOCUMENTS

| | | | | |
|---|---|---|---|---|
| 4,292,988 | A * | 10/1981 | Montgomery | E21B 21/10 137/68.17 |
| 7,661,478 | B2 | 2/2010 | Palmer et al. | |
| 10,273,769 | B2 | 4/2019 | Crow | |
| 10,287,835 | B2 | 5/2019 | Crow | |
| 2010/0132954 | A1 | 6/2010 | Telfer | |
| 2013/0186647 | A1 * | 7/2013 | Xu | E21B 23/01 166/382 |
| 2014/0060837 | A1 * | 3/2014 | Love | E21B 33/12 166/297 |

(Continued)

FOREIGN PATENT DOCUMENTS

CA 3048004 A1 12/2019

OTHER PUBLICATIONS

Filing Receipt, Specification and Drawing for U.S. Appl. No. 62/942,820, entitled "One Piece Frac Plug," filed Dec. 3, 2019, 46 pages.

(Continued)

*Primary Examiner* — Steven A MacDonald
(74) *Attorney, Agent, or Firm* — Conley Rose, P.C.; Rodney B. Carroll

(57) ABSTRACT

A collet comprising a collet ring, a plurality of collet fingers, and an object seat (e.g., ball seat), wherein the object seat comprises a surface (e.g., a curved surface) configured to interface with a correspondingly sized blocking object (e.g., a ball, dart, etc.) to form a seal therebetween, wherein each of the plurality of collet fingers has a first end and a second end, wherein the first end is proximate the collet ring, and wherein the second end of at least a portion of the plurality of collet fingers comprises a key (e.g., a tab) that is configured to engage a corresponding latch of a downhole structure.

19 Claims, 5 Drawing Sheets

(56) References Cited

U.S. PATENT DOCUMENTS

| | | | | |
|---|---|---|---|---|
| 2015/0129215 | A1* | 5/2015 | Xu | E21B 33/12 166/285 |
| 2015/0204162 | A1* | 7/2015 | Gay | E21B 34/08 166/373 |
| 2015/0308229 | A1 | 10/2015 | Patton et al. | |
| 2016/0251923 | A1* | 9/2016 | Keerthivasan | E21B 33/12 166/383 |
| 2016/0305215 | A1* | 10/2016 | Harris | E21B 33/1291 |
| 2017/0130553 | A1* | 5/2017 | Harris | E21B 33/1208 |
| 2017/0145781 | A1* | 5/2017 | Silva | E21B 33/134 |
| 2017/0321514 | A1* | 11/2017 | Crow | E21B 23/06 |
| 2018/0230774 | A1 | 8/2018 | Wood | |
| 2018/0320479 | A1 | 11/2018 | Wang et al. | |
| 2019/0234175 | A1 | 8/2019 | Crow et al. | |
| 2020/0056467 | A1* | 2/2020 | Wood | E21B 34/142 |
| 2020/0355054 | A1* | 11/2020 | Fripp | E21B 47/06 |

OTHER PUBLICATIONS

Foreign Communication from Related Application—Canadian Office Action dated Jan. 6, 2022 (4 pages), Canadian Patent Application No. 3,097,168, filed Oct. 27, 2020.

Foreign Communication from Related Application—Canadian Office Action, Canadian Patent Application No. 3,097,168, dated Jul. 20, 2022, 5 pages.

* cited by examiner

ONE PIECE FRAC PLUG

CROSS-REFERENCE TO RELATED APPLICATIONS

This application claims priority under 35 U.S.C. § 119(e) to U.S. Provisional Patent Application No. 62/942,820 filed on Dec. 3, 2019 and entitled "One Piece Frac Plug," the disclosure of which is hereby incorporated herein by reference in its entirety.

STATEMENT REGARDING FEDERALLY SPONSORED RESEARCH OR DEVELOPMENT

Not applicable.

TECHNICAL FIELD

The present disclosure relates generally to systems and methods for isolating a zone within a wellbore.

BACKGROUND

Wellbores are drilled to locate and produce hydrocarbons from a formation. Often, it is desirable to isolate a zone within the wellbore such that pressure can be applied, for example from the surface, to the isolated zone.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
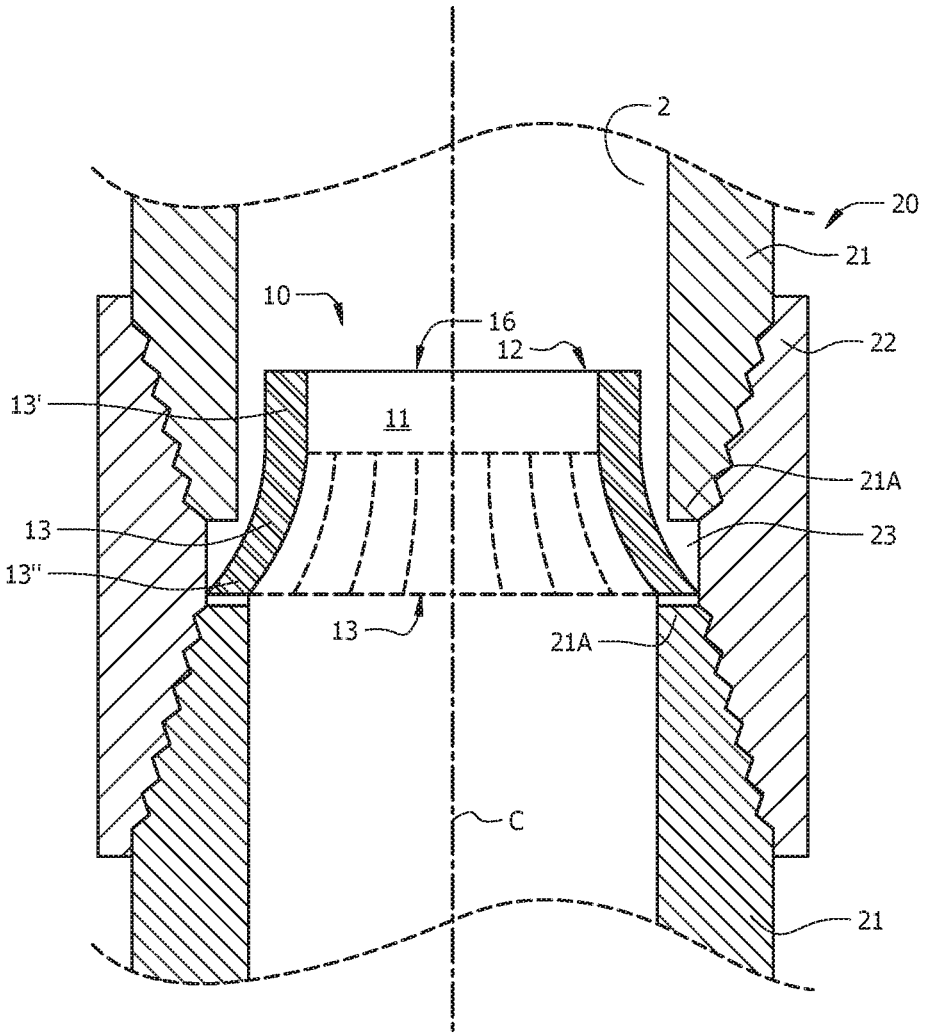
FIG. 1 is a schematic side cross section view of a collet of this disclosure engaged with a downhole structure of a wellbore.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

The term "formation" as utilized herein includes a subsurface formation, a subterranean formation, and a subsea formation.

As utilized herein, an "uphole" position is a position a shorter distance along the wellbore from a surface than a "downhole" position.

As utilized herein, "frac" indicates "fracturing".

A descriptor numeral can be utilized generically herein to refer to any embodiment of that component. For example, a collet 10 can refer to a first collet 10A, a second collet 10B, a third collet 10C, as described hereinbelow with reference to FIG. 4 and FIG. 5, and so on. By way of further example, a blocking object 30 can be utilized to indicate a first blocking object 30A, a second blocking object 30B, a third blocking object, as described hereinbelow with reference to FIG. 4, and so on.

Herein disclosed are collets, systems and methods for isolating zones of a wellbore, for example such that pressure can be applied to the isolated zone. Via this disclosure, a different style of frac plug is provided that comprises a collet that engages a profile provided by a latch in a downhole structure (e.g., a casing), rather than a conventional slip. The collet anchors a plug or "blocking object". In some applications, collet fingers of the collet also provide a blocking object seat (e.g., a ball seat) for the blocking object.

A collet of this disclosure comprises a collet ring, a plurality of collet fingers, and a blocking object seat (e.g., ball seat), which is also referred to herein as an "object seat". The object seat comprises a surface (e.g., a curved surface) configured to interface with a correspondingly sized blocking object (e.g., a ball, dart, etc.) to form a seal therebetween (i.e., between the blocking object seat and the blocking object), such that fluid cannot flow between the blocking object and the blocking object seat. The seal can enable, for example, subsequent pressurization of an uphole portion of the wellbore. Each of the plurality of collet fingers has a first end and a second end. The first end of each collet finger is proximate the collet ring. The second ends of at least a portion of the plurality of collet fingers are configured to engage a corresponding latch of a downhole structure. The second ends of the at least the portion of the plurality of collet fingers can comprise a key (e.g., a tab) that is configured to engage the corresponding latch of the downhole structure.

Figure 2C:
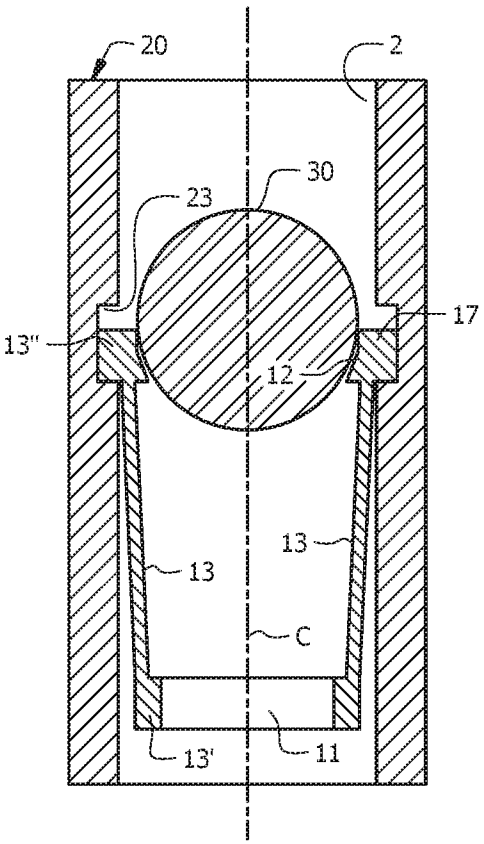
FIG. 2C is a schematic side cross section view of the collet of FIG. 2B with a blocking object (e.g., a ball) positioned to contact the blocking object seat (e.g., ball seat) of the collet.

FIG. 1 is a schematic side cross section view of a collet 10 engaged with a downhole structure 20 of a wellbore 2 according to aspects of this disclosure. Collet 10 comprises collet ring 11, a plurality of collet fingers 13, and a blocking object seat (e.g., ball seat) 12. The blocking object seat 12 comprises a surface 16 (e.g., a curved surface) configured to interface with a correspondingly sized blocking object (e.g., a ball, dart, etc.) to form a seal therebetween (i.e., between the blocking object seat and the blocking object), such that fluid cannot flow between the object and the blocking object seat 12. Blocking object seat 12 can comprise a cylindrical ring having a surface 16 between an outer diameter and an inner diameter thereof that is curved or otherwise complementarily shaped to seal with a blocking object (30; FIG. 2C) when engaged therewith.

Each of the plurality of collet fingers 13 has a first end 13' and a second end 13". The first end 13' of each collet finger 13 is proximate the collet ring 11. The second ends 13" of at least a portion of the plurality of collet fingers 13 are configured to engage a corresponding latch 23 of downhole structure 20. The second ends 13" of the at least the portion of the plurality of collet fingers 13 can comprise a key (e.g., a tab) that is configured to engage a corresponding latch 23 of downhole structure 20. The blocking object seat 12 can be disposed in collet ring 11 (as depicted in FIG. 1) proximate first end 13' of collet fingers 13, or can be disposed at an opposite end (e.g., second end 13") of collet fingers 13 and can be further defined by keys 17 (e.g., tabs) at the second ends 13" of at least a portion of the collet fingers 13.

In embodiments, such as the embodiment of FIG. 1, the collet 10 is configured such that, during operation, the collet ring 11 is in an uphole position (e.g., a shorter distance along the wellbore 2 from a surface (5, FIG. 5) of the wellbore 2) relative to the second ends 13" of the plurality of collet fingers 13. As depicted in FIG. 1, the collet ring 11 can comprises the blocking object seat (e.g., ball seat) 12.

Figure 2B:
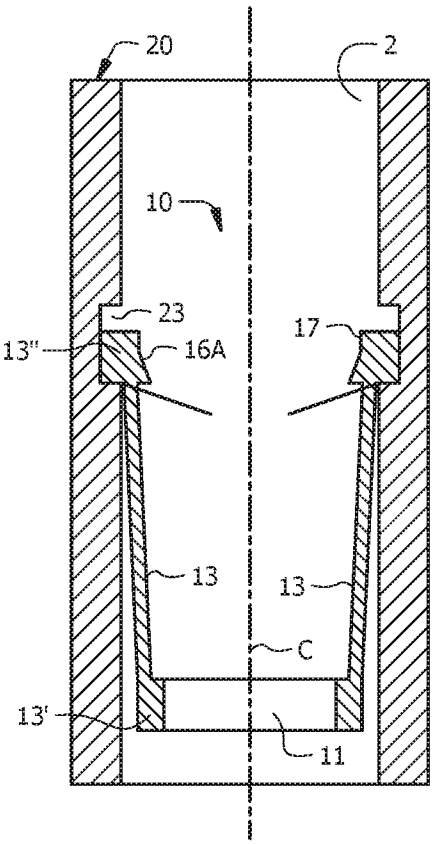
FIG. 2B is a schematic side cross section view of the collet of FIG. 2A engaged with a downhole structure of the wellbore.
Figure 2A:
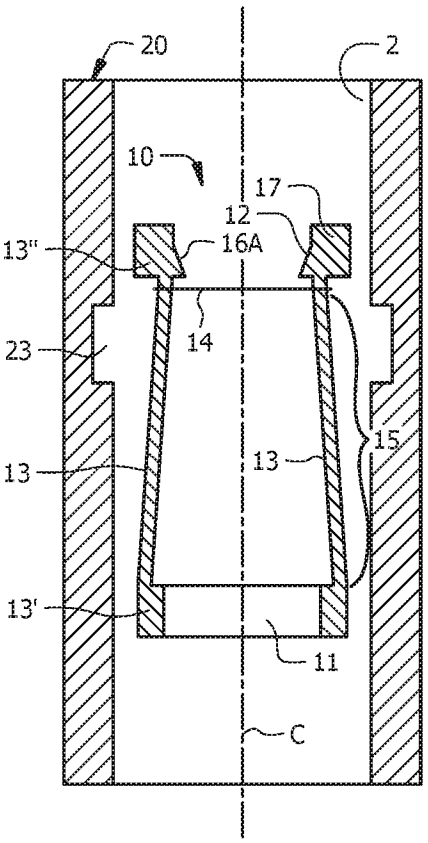
FIG. 2A is a schematic side cross section view of a collet of this disclosure within a wellbore.

FIG. 2A is a schematic side cross section view of a collet 10 within a wellbore 2. Collet 10 comprises collet ring 11, a plurality of collet fingers 13, and a blocking object seat (e.g., ball seat) 12. The blocking object seat 12 comprises a surface 16 (e.g., a curved surface) configured to interface with a correspondingly sized blocking object (e.g., a ball, dart, etc.) to form a seal therebetween (i.e., between the blocking object seat 12 and the blocking object), such that fluid cannot flow between the blocking object and the blocking object seat 12. Each of the plurality of collet fingers 13 has a first end 13' and a second end 13". The first end 13' of each collet finger 13 is proximate the collet ring 11. The second ends 13" of at least a portion of the plurality of collet fingers 13 are configured to engage a corresponding latch 23 of downhole structure 20. As depicted in FIG. 2A, the second ends 13" of the at least the portion of the plurality of collet fingers 13 can comprise a key 17 (e.g., a tab) that is configured to engage the corresponding latch 23 of downhole structure 20. Collet 10 of FIG. 2A is configured such that, during operation, the collet ring 11 is in a downhole position (e.g., a longer distance along the wellbore 2 from a surface (5, FIG. 5) of the wellbore 2) relative to the second ends 13" of the plurality of collet fingers 13.

In the embodiment of FIG. 1, the collet fingers 13 extend downhole (e.g., below) the blocking object seat 12. In FIG. 1, downhole structure 20 comprises a casing joint comprising two tubulars 21 connected via (e.g., threadably coupled with) casing collar 22 (also referred to herein as "collar 22"). The second ends 13" of collet fingers 13 engage with (e.g., snap into) latch 23 of the casing joint comprising the casing collar 22 of downhole structure 20. The blocking object seat 12 faces uphole so that a blocking object (e.g., ball) can land and create a seal between the blocking object seat 12 and the blocking object. Additional force can be applied to push the second ends 13" of the collet fingers 13 deeper into the profile provided by latch 23 of downhole structure 20. Collet fingers 13 are designed to be sufficiently thick to support the axial load (e.g., of pressurized blocking object 30), while also being flexible enough to engage in the profile/latch 23.

In the embodiment of FIG. 2A, the blocking object seat 12 is formed by the keys 17 of the at least the portion of the plurality of collet fingers 13. That is, each of the keys 17 has a curved surface 16A, such that, when the collet is in an extended configuration in which the collet fingers 13 extend radially outward from centerline C of the collet 10, the curved surfaces 16A of the keys 17 of the at least the portion of the plurality of the collet fingers 13 provide the blocking object surface 12. In the embodiment of FIG. 2A to FIG. 2C, the collet fingers 13 extend uphole from collet ring 11. The second ends 13" of collet fingers 13 (e.g., tabs or keys 17 thereof) can fit (e.g., snap) into a profile or latch 23 disposed in the downhole structure 20, which downhole structure 20 can comprise, for example, a tubular, a casing, a casing joint, a casing collar, a sliding sleeve (also referred to as a "slidable sleeve"), or another downhole structure. In alternative embodiments, collet ring 11 of FIG. 2A to FIG. 2C comprises the blocking object seat 12.

As depicted in FIG. 2A, collet fingers 13 can comprise a first end 13' in contact with collet ring 11 and a second end 13" comprising keys or tabs 17 separated by a flexure 15. One of the advantages of the embodiment of FIG. 2A can be that the flexures 15 can be very thin and flexible, as the pressure holding strength arises from the blocking object (e.g., ball; 30, FIG. 2C) preventing the collet fingers 13 from moving radially inward. As depicted in FIG. 2C, which is a schematic side cross section view of the collet of FIG. 2A and FIG. 2B with a blocking object (e.g., a ball) 30 positioned to contact the blocking object seat (e.g., ball seat) 12 of the collet 10, a blocking object 30 (e.g., a frac ball) can be positioned within the collet fingers 13, thus preventing the collet fingers 13 from closing.

Each of the plurality of collet fingers 13 can be biased to extend radially outward from centerline C of collet 10. The collet 10 can further comprise a retainer 14 (FIG. 2A) configured to prevent the plurality of collet fingers 13 from extending radially outward when the collet 10 is in a retained configuration and allow the plurality of collet fingers 13 to extend radially outward when the collet 10 is in an unretained configuration. The retainer 14 can be configured such that an application of energy to the retainer 14 can be utilized to release the plurality of collet fingers 13, whereby the collet 10 assumes the unretained or "extended" configuration. The retainer 14 can comprise, for example, a retaining sleeve positioned at least partially about the plurality of collet fingers 13 thus preventing extension of the plurality of collet fingers 13 radially outward from centerline C until the retaining sleeve is at least partially removed from about the plurality of collet fingers 13. By way of further non-limiting example, the retainer 14 can comprise an electro-explosive that retains the plurality of collet fingers 13, thus preventing extension of the plurality of collet fingers 13 radially outward from centerline C until electricity is passed through the retainer 14. Passage of electricity through retainer 14 can result in a chemical reaction that leads to degradation (e.g., burning) of the retainer 14 and outward radial extension of the plurality of collet fingers 13, as depicted in FIG. 2B, which is a is a schematic side cross section view of the collet 10 of FIG. 2A engaged with a downhole structure 20 of the wellbore 2, wherein the retainer 14 has been degraded (e.g., broken), allowing extension of the collet fingers 13 from centerline C of the collet 10 such that second ends 13" of collet fingers 13 can engage downhole structure 20. Retainer 14 can comprise an electro-explosive, such as, for example and without limitation, a bridgewire, Kevlar wire, or fusible alloy. Such a suitable bridgewire can comprise, for example, aluminum clad with palladium.

In embodiments, therefore, flexures 15 can be biased to push the collet fingers 13 radially outward from centerline C of collet 10, such that the second ends 13" (e.g., keys 17 thereof) into the profile or latch 23 within the downhole structure 20 (e.g., casing 21), and a mechanism (e.g., retainer 14) can hold the flexures 15 to prevent their premature deployment. With reference to FIG. 2A, the flexures 15 can be held with an electro-explosive retainer 14, such as with a bridgewire. The bridgewire can be made from aluminum clad with palladium that undergoes a strongly exothermic reaction. The release of the collet fingers 13 can be, for example, via the application of energy, such as from heating, such as by heating of a Kevlar wire retainer 14 that burns with high electrical power or a heating of a fusible alloy retainer 14, whereby the fusible alloy melts and releases the collet fingers 13. In applications, the collet fingers 13 can be pushed or otherwise separated from a housing or retaining sleeve retainer 14 as part of the setting process.

Downhole structure 20 can comprise, for example and without limitation, a tubular having latch 23 disposed therein, a casing collar 22 having latch 23 disposed therein, a casing joint having latch 23 disposed therein, or a sliding sleeve 26 (FIG. 4) having the latch 23 disposed therein. For example, in the embodiment of FIG. 1, latch 23 is disposed in a casing joint comprising a casing collar 22 threadably coupled with two tubulars or casing sections 21. In such aspects, a space or gap between adjacent ends 21A of the tubulars 21 joined by collar 22 can provide latch 23 with which the second ends 13" of the at least the portion of the plurality of collet fingers 13 engage during operation. By way of further example, in the embodiment of FIG. 2A to FIG. 2C, latch 23 is disposed in a downhole structure 20 comprising, for example, a tubular or casing 21. In such aspects, a profile disposed within the tubular or casing 21 can provide latch 23 with which the second ends 13" of the at least the portion of the plurality of collet fingers 13 engage during operation.

Figure 3A:
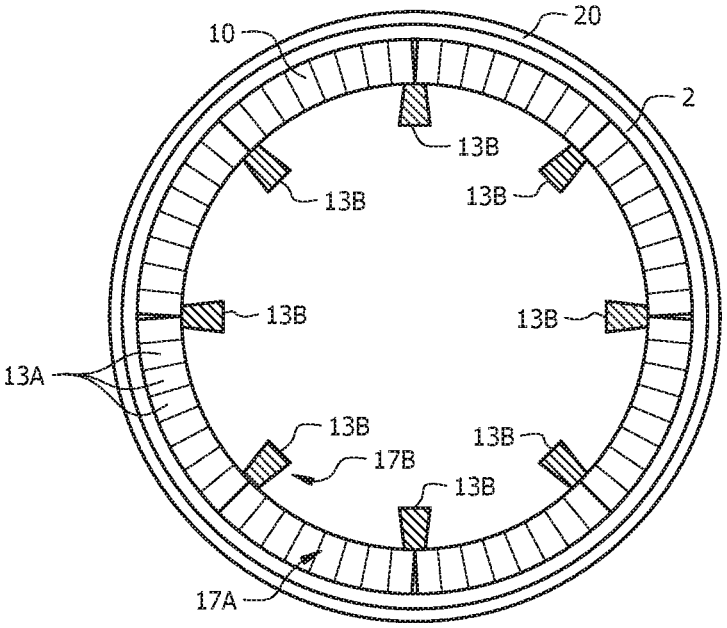
FIG. 3A is a schematic top cross section view of a collet of this disclosure in a retained configuration.
Figure 3B:
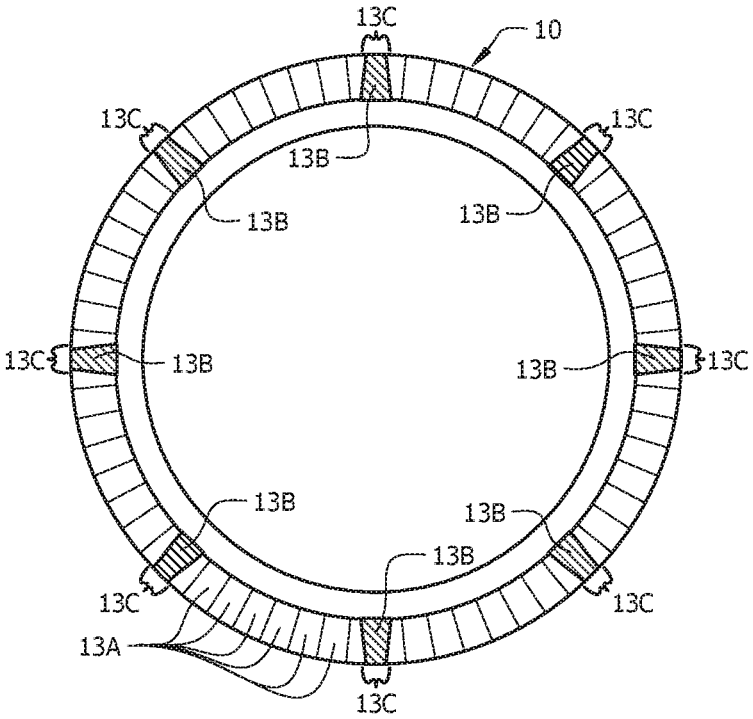
FIG. 3B is a schematic top cross section view of the collet of FIG. 3A in an unretained or extended configuration.

The collet 10 of this disclosure can comprise a continuous structure (or nearly continuous structure) around the circumference of the collet 10 when the collet 10 is engaged within the latch 23. In some embodiments, the continuous structure is formed with a primary layer or row comprising primary collet fingers and: a secondary layer or row comprising secondary collet fingers; and/or additional material (e.g., overlaps, webbing, or the like). The secondary layer or row and/or the additional material can be configured such that, upon extension of the primary collet fingers whereby the collet goes from a retained configuration to an unretained configuration, gaps formed among the primary collet fingers are at least partially or entirely filled by the secondary collet fingers and/or the additional material. For example, with reference to FIG. 3A, which is a schematic top cross section view of a collet according to aspects of this disclosure in a retained configuration, and FIG. 3B, which is a schematic top cross section view of the collet of FIG. 3A in an extended configuration, a primary layer or row 17A comprises primary collet fingers 13A (only a few of which are labeled in FIG. 3A and FIG. 3B for clarity) and a secondary layer or row 17B comprises secondary collet fingers 13B. The secondary layer or row 17B and/or the additional material can be configured such that, upon extension of the primary collet fingers 13A whereby the collet 10 goes from the retained configuration (FIG. 3A) to the unretained configuration (FIG. 3B), gaps 13C (FIG. 3B) formed among the primary collet fingers 13A are at least partially or entirely filled by the secondary collet fingers 13B and/or the additional material. As seen in FIG. 3B, in the extended configuration, the secondary collets 13B fill the gaps 13C among primary collets 13A. In embodiments, in the retained configuration, the primary layer or row 17A and the secondary layer or row 17B are nested. Upon transitioning from the retained configuration to the unretained configuration, the gaps 13C can be filled by the second layer or row of collet fingers and/or the additional material such that, during operation, leakage of fluid between the object seat 12 and the blocking object (e.g., ball) 30 is substantially minimized or eliminated. Upon transitioning from the retained configuration to the unretained configuration, the gaps 13C can be filled by the second layer or row of collet fingers and/or the additional material such that, the collet 10 forms a continuous or substantially continuous structure around the circumference. For example, in FIG. 3B, the collet 10 is in the extended or unretained configuration, and forms a nearly continuous structure around the circumference. In FIG. 3B, the collet 10 is in the extended or unretained configuration, and forms a nearly continuous structure around the circumference. When collet 10 is in a retained configuration, the secondary layer or row 17B of collet fingers can be, for example, twisted and/or stacked in a spiral within and/or above primary layer or row 17A of collet fingers, such that, when released by removal and/or alteration of retainer 14, gaps 13C are filled when collet 10 assumes the extended or unretained configuration.

In embodiments, the gaps 13C between the primary collets 13 can be sealed either through overlaps (e.g., of primary collets 13A) or through additional collets (e.g., secondary collets 13B). As shown in FIG. 3A and FIG. 3B, additional collets (e.g., secondary collets 13B) can be utilized to fill the space or gaps 13C between the primary collets 13A as they move radially outward. Additional collets (e.g., secondary collets 13B) can be especially useful in configurations, such as depicted in FIGS. 2A-2C, where there is large radial movement outward of the flexures 15 upon extension and engagement of downhole structure 20.

In embodiments, collet 10 comprises no parts that move relative to each other, other than extension radially outward from centerline C of collet 10 and/or retaining radially inward from centerline C of collet 10 of the plurality of collet fingers 13.

The keys 17 of the second ends 13" of the at least the portion of the plurality of collet fingers 13 can have a key profile and the corresponding latch 23 of downhole structure 20 can have a latch profile, and the key profile and the latch profile can be complementary profiles.

Figure 5:
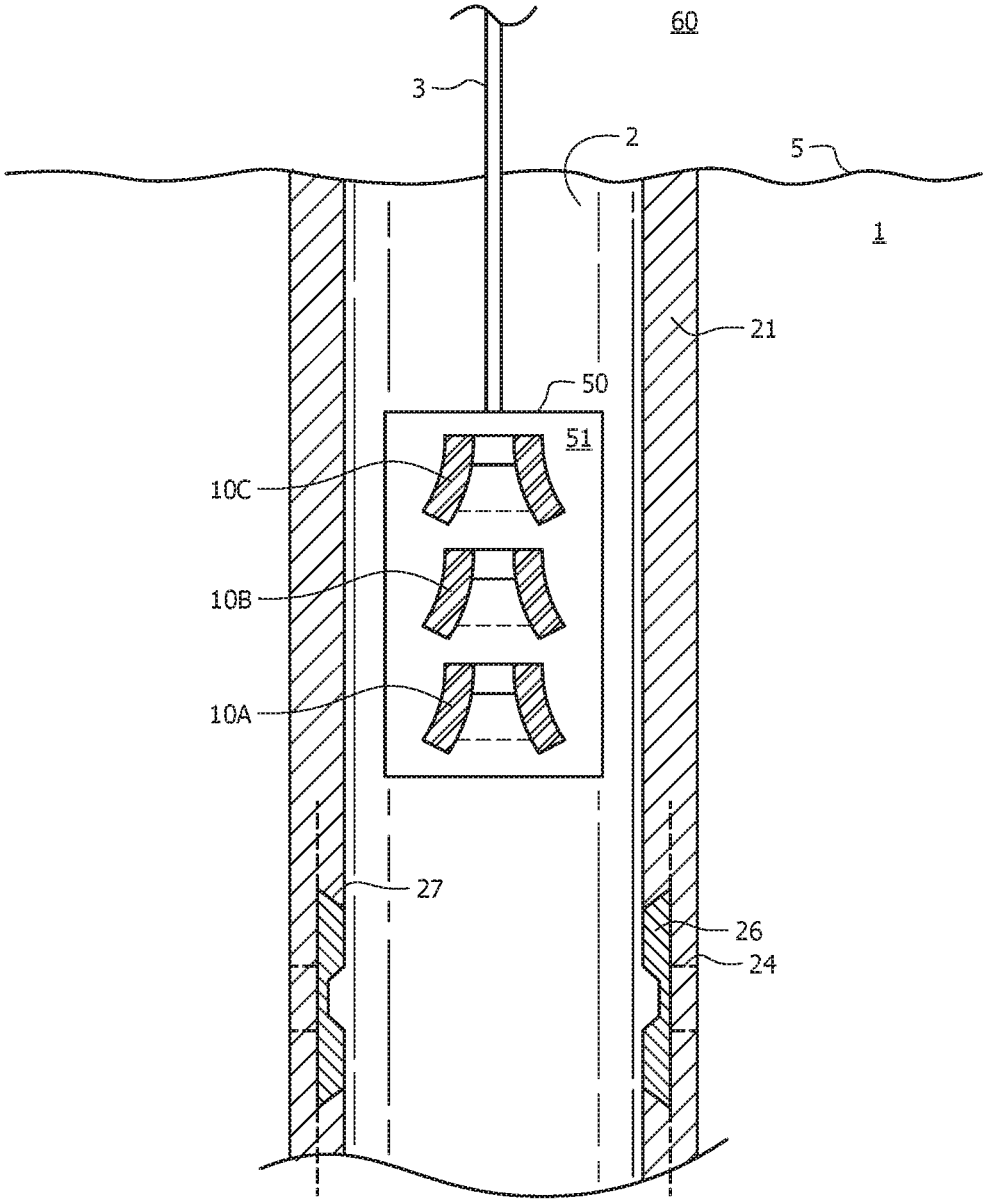
FIG. 5 is a schematic of a wellsite comprising a wireline and a conveying tool for positioned one or more collets of this disclosure within a wellbore.

The collet 10 can be made from any suitable material. For example and without limitation, collet 10 can comprise one or more metals. In embodiments, the collet 10 comprises a consumable material. The consumable material can comprise, for example, a dissolvable material, whereby the collet can be dissolved subsequent usage thereof. Any dissolvable materials and methods of dissolving same can be utilized. The collet 10 can be configured such that after engaging the second ends 13" of the at least the portion of the plurality of collet fingers 13 with latch 23, and engaging a blocking object (e.g., a ball) 30 with blocking object seat 12, pressure can be supplied (e.g., from surface 5; FIG. 5) within wellbore 2, and fluids are blocked from flowing past collet 10 (e.g., between blocking object 30 and blocking object (e.g., ball) seat 12 of collet 10).

A collet 10 of this disclosure can be utilized as a plug, for example, that can be utilized to isolate a zone of casing 21 for perforating with perforating guns. A collet 10 of this disclosure can be utilized as a frac plug, for example, that can be utilized to isolate a zone of casing 21 for introducing fracturing fluid from the wellbore into a zone of the formation surrounding the wellbore. In embodiments, the collet (e.g., one-piece plug) can be utilized for engagement with a latch 23 within a downhole structure 20 comprising a sliding sleeve 26. In such applications, hydraulic pressure on the blocking object 30 (e.g., a frac ball) can operate to open the sleeve 26, allowing fluid flow from within wellbore 2 to the surrounding formation 1 (e.g., via ports 24 described further hereinbelow with reference to FIG. 4), and/or vice versa.

Also disclosed herein is a system comprising a plurality of collets 10. For example, a system of this disclosure can comprise at least two, three, four, five, or more collets 10.

Figure 4:
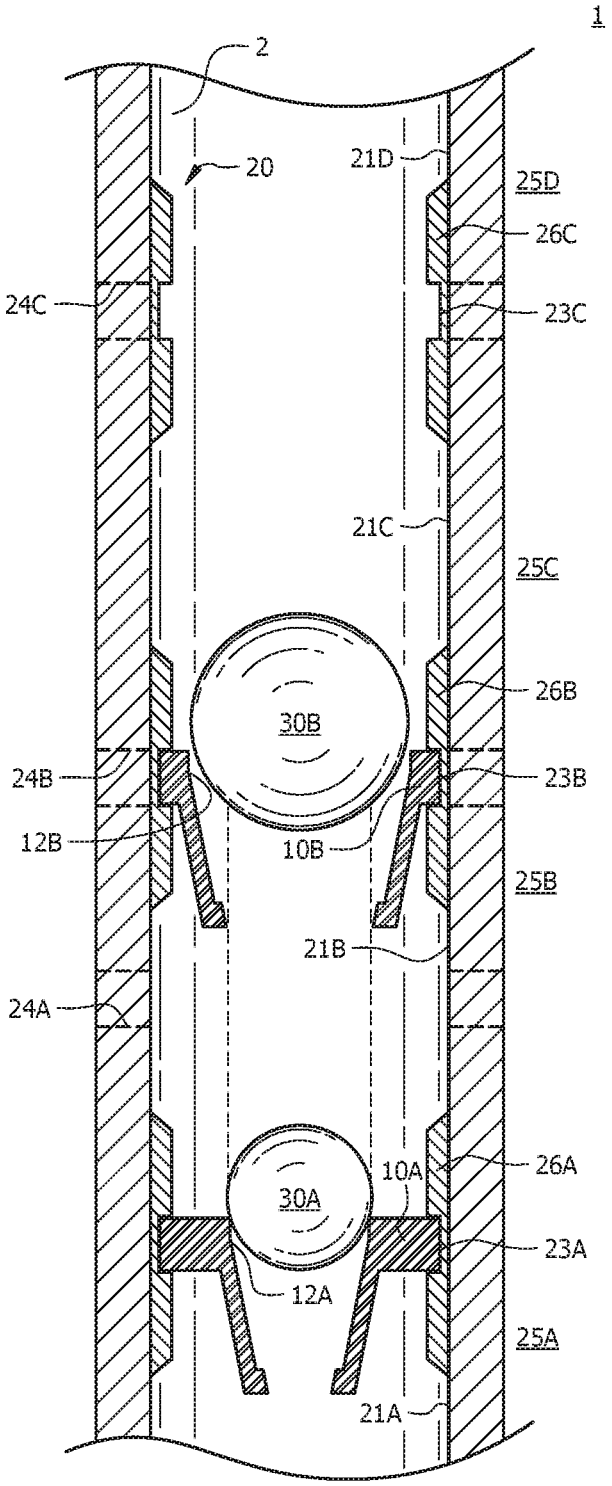
FIG. 4 is a schematic side cross section view of a wellbore having three sliding sleeves and two collets of this disclosure disposed therein.

For example, with reference to FIG. 4, which is a schematic side cross section view of a wellbore 2 having three sliding sleeves 26 (e.g., first sliding sleeve 26A, second sliding sleeve 26B, and third sliding sleeve 26C) and two collets (e.g., first collet 10A and second collet 10B) disposed therein according to aspects of this disclosure, a series of collets 10 can be installed, wherein each of the collets 10 has a different diameter. For example, a first collet 10A can be installed at a first (e.g., most downhole) location within wellbore 2, such that first collet 10A engages a downhole structure 20 comprising a first sliding sleeve 26A having a first latch 23A disposed therein, and a second collet 10B can be installed at a second location uphole from the first location within wellbore 2, such that second collet 10B engages a downhole structure 20 comprising a second sliding sleeve 26B having a second latch 23B disposed therein. First collet 10A provides a blocking object seat 12A having a diameter that is less than a blocking object seat diameter 12B provided by second collet 10B. A first blocking object 30A (e.g., a first ball) can pass through second collet 10B and land on first collet 10A, and pressure applied for opening first sliding sleeve 26A, and isolating first zone 21A of casing 21 from second zone 21B of casing 21. Second blocking object 30B, having a larger diameter than first blocking object 30A, can be introduced (e.g., dropped) into wellbore 2, thus landing on second collet 10B and pressure applied for opening second sliding sleeve 26B, whereby second zone 21B of casing 21 can be isolated from first zone 21A of casing 21. The sleeves 26 (e.g., first sleeve 26A, second sleeve 26B, and third sleeve 26C) can be recessed within downhole structure (e.g., tubular or casing) 20, for example, within a cylindrical groove (27; FIG. 5), such that flow within wellbore 2 is not impeded thereby. The groove 27 can extend along wellbore 2 such that the sliding sleeve 26 can transition from a closed position, in which the sleeve 26 covers ports 24 (e.g., frac ports 24), thus sealing them from fluid communication with wellbore 2, to an open position, in which ports 24 are open (e.g., not covered by sleeve 26) and thus allow fluid flow between wellbore 2 and the formation 1 surrounding wellbore 2.

As depicted in FIG. 5, which is a schematic of a wellsite 60 comprising a wireline 3 and a conveying tool 50 for positioning one or more collets 10 of this disclosure within a wellbore 2, a system of this disclosure can comprise a collet or a plurality of collets 10 as described herein, and a conveyance or deployment structure via which the collet or plurality of collets 10 can be positioned downhole within a wellbore 2. The conveyance can comprise a wireline cable 3 and a conveying tool 50 to which the collet or the plurality of collets 10 is attached. The system can further comprise a locator 51 (e.g., a location sensor) configured to determine when the collet or the plurality of collets 10 is proximate the downhole structure 20. The locator 51 can be within a conveying tool 50 of the conveyance or deployment structure, and the conveying tool 50 attached to and/or at least partially containing the collet(s) 10. The locator 51 can be utilized to determine proximity to downhole structure 20, for example, by counting casing collars 22 passed by the collet(s) 10 during deployment downhole. Locator 51 can thus be utilized to determine when the a collet 10 being moved downhole is proximate a corresponding latch 23 (e.g., has reached a collar 22 of a casing joint within which latch 23 is disposed), after which a mechanism can activate release of collet fingers 13 from retainer 14 of the collet 10 and/or release of the collet 10 from conveying tool 50. A retainer 14 of the collet 10 may be released, for example, when the collet 10 is within a certain distance (e.g., a casing joint length) of a latch 23 with which the collet 10 is to be engaged (e.g., when collet 10 is within a certain distance of a latch 23 having a profile that can be corresponding or complementary to second ends 13" (e.g., keys 17 thereof) of the at least the portion of collet fingers 13) of the collet 10. In this manner, the second ends 13" of collet fingers 13 need not scrape along an inner diameter of wellbore 2 the entire length thereof during the trip (e.g., wireline trip) downhole. A system of this disclosure can comprise a plurality of collets 10. For example, a system of this disclosure can comprise at least two, three, four, five, or more collets 10.

A system of this disclosure can comprise the collet 10, as described herein, wherein the second ends 13" of the collet fingers 13 of the at least the portion of the plurality of collet fingers 13 are coupled with the latch 23 of the downhole structure 20, and the downhole structure 20. As noted hereinabove, the downhole structure 20 can comprise a sliding sleeve 26 (e.g., first sliding sleeve 26A, second sliding sleeve 26B, and third sliding sleeve 26C, as described herein with reference to the embodiment of FIG. 4), a casing joint, or a casing collar 22 (FIG. 1).

A blocking object 30, such as a ball, can be positioned in contact with the blocking object seat 12. The blocking object can be positioned in the blocking object seat 12 such that fluid cannot flow between the blocking object (e.g., ball) 30 and the blocking object seat 12. The blocking object 30 can comprise a ball, a dart, or another blocking object.

A collet 10 of this disclosure can be made by any methods known to those of skill in the art and with the aid of this disclosure. For example, a collet 10 can be machined, milled, cast, or the like.

Also disclosed herein is a method comprising: running a collet 10 as described herein downhole into a wellbore 2; and engaging the latch 23 of the downhole structure 20 with the at least the portion of the plurality of collet fingers 13. Running the collet 10 downhole can further comprise retaining the plurality of collet fingers 13 (e.g., flexures 15 of collet fingers 13) with a retainer 14, locating a position proximate the latch 23, and releasing the plurality of collet fingers 13 from the retainer 14, whereby the plurality of collet fingers 13 extend radially outward from centerline C of the collet 10, and running the collet 10 further downhole to a location of the latch 23, prior to engaging the latch 23 of the downhole structure 20 with the at least the portion of the plurality of collet fingers 13.

In embodiments, the retainer 14 comprises: a retaining sleeve disposed about the plurality of collet fingers 13, and releasing the plurality of collet fingers 13 comprises at least partially removing the retaining sleeve from about the plurality of collet fingers 13. In embodiments, the retainer 14 comprises an electro-explosive, and releasing the plurality of collet fingers 13 comprises degrading the retainer 14 via passage of electricity to the electro-explosive.

Locating the position at which collet fingers 13 are released from retainer 14 and/or collet 10 is released from a conveyance (e.g., wireline 3 and/or conveying tool 50) can be performed utilizing a locator 51, as described hereinabove. Once the position at which collet fingers 13 are to be released has been reached, the releasing of the plurality of collet fingers 13 and/or release of a collet 10 from the conveyance (e.g., from wireline 3 and/or conveying tool 50) can be initiated via a signal from a surface 5 (FIG. 5). The signal can be transmitted to the collet 10 wirelessly and/or via a wireline cable 3 and/or a conveying tool 50 utilized to convey the collet 10 downhole. Releasing the plurality of collet fingers 13 can comprise at least partially removing the retaining sleeve from about the plurality of collet fingers 13 during a perforation process. For example, in aspects, a frac plug comprising a collet 10 of this disclosure can be released as part of a process of firing perforating guns.

Running the collet 10 downhole can further comprise running the collet 10 downhole via a wireline cable 3. For example, with reference to FIG. 5, which is a schematic of a wellsite 60 comprising a wireline 3 and a conveying tool 50 for positioning one or more collets 10 of this disclosure within a wellbore 2, the collet 10 can be run downhole via a conveying tool 50 coupled to a wireline cable 3. In embodiments, the method can comprise running a plurality of collets 10 downhole, and engaging the at least the portion of the plurality of collet fingers 13 of each of the plurality of collets 10 with a corresponding latch 23 of a downhole structure 20. The plurality of collets 10 can be run downhole via a single trip downhole (e.g., a single wireline trip), or via multiple trips downhole (e.g., multiple wireline trips).

The method can further comprise pumping a blocking object (e.g., a ball, dart, another blocking object) 30 downhole and engaging the blocking object seat 12 with the blocking object 30, whereby the engaging of the object seat 12 with the blocking object 30 blocks flow of fluid between the blocking object (e.g., ball) 30 and the blocking object seat 12. The method can further comprise treating a region of the wellbore 2 uphole of (e.g., a shorter length along the wellbore 2 from a surface 5 of the wellbore 2 than) the collet 10. Treating can comprise applying pressure to a region of the wellbore 2 uphole of (e.g., a shorter length along the wellbore 2 from a surface 5 of the wellbore 2 than) the collet 10. Applying pressure can actuate the downhole structure 20 to which the collet 10 is engaged. For example and without limitation, the downhole structure 20 can comprise a sliding sleeve 26 (first sliding 26A, second sliding sleeve 26B, third sliding sleeve 26C, as described hereinbelow with reference to FIG. 4), and actuating the downhole structure 20 can open the sliding sleeve 26/26A/26B/26C whereby fluid can flow from the wellbore 2 into a formation 1 surrounding the wellbore 2 via, for example, (e.g., frac) ports 24. Treating can comprise flowing fluid from the wellbore 2 into the formation 1. In embodiments, the fluid can comprise a fracturing fluid. Alternatively and without limitation, treating can comprise firing a perforating gun to perforate a casing 21.

As depicted in FIG. 4, which is a schematic side cross section view of a wellbore 2 having three sliding sleeves (first sliding sleeve 26A, second sliding sleeve 26B, and third sliding sleeve 26C) and two collets (first collet 10A and second collet 10B) disposed therein according to aspects of this disclosure, a method of this disclosure can comprise: treating a first zone 25A of a formation 1 surrounding a wellbore 2 comprising a casing 21 via a first zone 21A of the casing 21 adjacent the first zone 25A of the formation, engaging a blocking object with a collet 10 of this disclosure, wherein the collet 10 is in an extended or unretained configuration in which the plurality of collet fingers 13 extend radially outward from a centerline C of the collet 10 and the second ends 13" (e.g., keys 17) of the at least the portion of the plurality of collet fingers 13 of the collet 10 engage a corresponding latch 23 of the downhole structure 20, and wherein the collet is positioned within the wellbore 2 above or within the first zone 21A of the casing 21; and treating a second zone of the formation 25B via a second zone 21B of the casing 21 above the collet 10.

As depicted in FIG. 4, the collet 10 can be a first collet 10A and the blocking object 30 can be a first blocking object 30A, and the method can further comprise: engaging a second blocking object 30B with a second collet 10B whereby the second blocking object 30B contacts the blocking object seat 12 of the second collet 10B, wherein the second collet 10B is a collet 10 according to this disclosure, wherein the second collet 10B is in an extended configuration in which the plurality of collet fingers 13 thereof extend radially outward from a centerline C of the second collet 10B and the second ends 13" (e.g., keys 17) of the at least the portion of the plurality of collet fingers 13 of second collet 10B engage a second latch 23A of the downhole structure 20, and wherein the second collet 10B is positioned within the wellbore 2 above or within the second zone 21B of the casing 21; and treating a third zone 25C of the formation 1 via a third zone 21C of the casing 21 above the second collet 10B; and/or optionally, engaging a third blocking object (30C, not shown in FIG. 4) with a third collet 10C (FIG. 5) whereby the third blocking object contacts the object seat 12 of the third collet 10C, wherein the third collet 10C is a collet 10 according to this disclosure, wherein the third collet 10C is in an extended configuration in which the plurality of collet fingers 13 thereof extend radially outward from a centerline C of the third collet 10C and the second ends 13" (e.g., keys 17) of the at least the portion of the plurality of collet fingers 13 of third collet 10C engage a third latch 23C of the downhole structure 20, and wherein the third collet 10C is positioned within the wellbore 2 above or within the third zone 21C of the casing 21; and treating a fourth zone 25D of the formation 1 via a fourth zone 21D of the casing 21 above the third collet 10C.

Treating a zone of the formation can comprise pressurizing a corresponding zone of the casing. For example, treating the first zone 25A of the formation 1 via the first zone 21A of the casing 21 can comprise pressurizing the first zone 21A of the casing 21; treating the second zone 25B of the formation 1 via the second zone 21B of the casing 21 above the (e.g., first) collet 10A can comprise pressurizing the second zone 21B of the casing 21 above the (e.g., first) collet 10A; treating the third zone 25C of the formation 1 via the third zone 21C of the casing 21 above the second collet 10B can comprise pressurizing the third zone 21C of the casing 21 above the second collet 10B; and/or treating the fourth zone 25D of the formation 1 via the fourth zone 21D of the casing 21 above the third collet 10C can comprise pressurizing the fourth zone 21D of the casing 21 above the third collet 10C.

Treating the zone of the formation can comprises fracturing or perforating the zone of the formation.

The method can further comprise positioning the first collet 10A, the second collet 10B, and/or the third collet (10C, FIG. 5) downhole as described hereinabove. In embodiments, the first collet 10A, the second collet 10B, and/or the third collet 10C are positioned downhole via a single trip downhole (e.g., a single wireline trip). In such embodiments, the first blocking object 30A can be sized to pass through the second collet 10B when the second collet 10B is in the extended configuration and, when the third collet 10C is present, the first blocking object 30A can be sized to pass through the third collet 10C when the third collet 10C is in the extended configuration; and, when the third collet 10C is present, the second blocking object 30B can be sized to pass through the third collet 10C when the third collet 10C is in the extended configuration. This sizing can be utilized with any number of collets 10 and blocking objects 30.

The keys 17 of the at least the portion of the plurality of collet fingers 13 of the first collet 10A can be engaged, via a first latch 23A, with a downhole structure 20 comprising a first sliding sleeve 26A having the first latch 23A disposed therein; the keys 17 of the at least the portion of the plurality of collet fingers 13 of the second collet 10B can be engaged, via a second latch 23B, with a downhole structure 20 comprising a second sliding sleeve 26B having the second latch 23B disposed therein, and/or the keys 17 of the at least the portion of the plurality of collet fingers 13 of the third collet 10C can be engaged, via a third latch 23C, with a downhole structure 20 comprising a third sliding sleeve 26C having the third latch 23C disposed therein, and so on.

The keys 17 of the at least the portion of the plurality of collet fingers 13 of the first collet 10A, the keys 17 of the at least the portion of the plurality of collet fingers 13 of the second collet 10B, and/or the keys 17 of the at least the portion of the plurality of collet fingers 13 of the third collet 10C, and so on, can be the same or different. Likewise, the first latch 23A, the second latch 23B, the third latch 23C, and so on, can be the same or different.

With reference back to FIG. 4, a method of this disclosure can comprise, subsequent fracturing a lower or first zone 25A of a formation 1 via a first zone 21A of casing 21, positioning a first blocking object 30A (e.g., a frac ball) on a first collet 10A engaged within wellbore 2 (e.g., having second ends 13" (e.g., keys 17 thereof) engaged with first latch 23A of first sleeve 26A), whereby a second zone 21A of the casing 21 is isolated from portions of the wellbore 2 below the first collet 10A. Application of pressure from surface 5 can cause first sleeve 26A to slide down such that first ports 24 provide access of fluid from a second zone 21B of casing 21 to surrounding formation 1. Second zone 25B of formation 1 can be fractured by introducing fracturing fluid from surface 1 to the surrounding formation 1 within second zone 25B of the formation 1 via second zone 21B of casing 21. Subsequent fracturing of the second zone 25B of the formation 1, a second blocking object (e.g., frac ball) 30B can be dropped and/or otherwise positioned on second collet 10B engaged within wellbore 2 (e.g., having second ends 13" (e.g., keys 17 thereof) engaged with second latch 23B of second sleeve 26B), whereby a third zone 21C of the casing 21 is isolated from portions of the wellbore 2 downhole from second collet 10B. Application of pressure from surface 5 can cause second sleeve 26B to slide down such that second ports 24B provide access of fluid from third zone 21C of casing 21 to surrounding formation 1. Third zone 25B of formation 1 can be fractured by introducing fracturing fluid from surface 1 to the surrounding formation 1 within third zone 25C of the formation 1 via third zone 21C of casing 21. Subsequent fracturing of the third zone 25C of the formation 1, a third blocking object (e.g., frac ball) 30C (not shown in FIG. 4) can be dropped and/or otherwise positioned on third collet 10C engaged within wellbore 2 (e.g., having second ends 13' (e.g., keys 17) engaged with third latch 23C of third sleeve 26C), whereby a fourth zone 21D of the casing 21 can be isolated from portions of the wellbore 2 downhole from third collet 10C. Application of pressure from surface 5 can cause third sleeve 26C to slide such that ports 24 provide access of fluid from a fourth zone 21D of casing 21 to surrounding formation 1. This process can be repeated for any number of additional uphole collets 10.

The first collet 10A, second collet 10B, third collet 10C, and so on, can be deployed into wellbore 2 via a single trip downhole (e.g., a single wireline trip), in embodiments, with a ball seat 12 of each successive collet 10 having a larger diameter (and thus requiring a larger diameter blocking object 30 for providing a seal between the blocking object 30 and the blocking object seat 12) than a previous (e.g., immediately downhole) collet 10 in the series. That is, first collet 10A can provide a first ball seat 12A having a smaller diameter than a second ball seat 12B provided by second collet 10B, second collet 10B can provide a second ball seat 12A having a smaller diameter than a third ball seat 12C provided by third collet 10C, and so on. In this manner, a blocking object 30 can pass through uphole collets 10 prior to landing on a ball seat of the collet on which it is to be landed for providing a seal. That is, first blocking object 30A can pass through (e.g., the ball seat 12 of) uphole collets including second collet 10B, third collet 10C, and so on; second blocking object 30B can pass through (e.g., the ball seat 12 of) uphole collets including third collet 10C (but not through (e.g., the ball seat 12 of) first collet 10A), and so on.

FIG. 4 depicts the state or configuration a system of this disclosure can assume after a method that comprises: pumping a first blocking object (e.g., a first ball) 30A downhole to engage first collet 10A, pressurizing to open first sliding sleeve 26A, whereby first sliding sleeve 26A moves down to expose first ports 24A, treating (e.g., fracturing) second zone 25B of formation 1, wherein treating second zone 25B comprise pressurizing wellbore 2 within second zone 21B of casing 21 above first collet 10A, and dropping or otherwise positioning a second blocking object (e.g., a second ball) 30B that is larger than first blocking object 30A downhole to engage second collet 10B. Subsequent the state depicted in FIG. 4, the method can further comprise: pressurizing to open second sliding sleeve 26B, whereby second sliding sleeve 26B moves down to expose second ports 24B; treating (e.g., fracturing) third zone 25C of formation 1, wherein treating third zone 25C can comprise pressurizing wellbore 2 within third zone 21C of casing 21 above second collet 10B; dropping or otherwise positioning a third blocking object (e.g., a third ball) (e.g., 30C; not shown in FIG. 4) that is larger than first blocking object 30A and second blocking object 30B downhole to engage a third collet (10C; FIG. 5); pressurizing to open third sliding sleeve 26C, whereby third sliding sleeve 26C moves down to expose third ports 24C; and/or treating (e.g., fracturing) fourth zone 25D of formation 1, wherein treating fourth zone 25D comprise pressurizing wellbore 2 within fourth zone 21D of casing 21 above third collet 10C, and so on.

Alternatively, a method of this disclosure can employ one or more collets 10, each having a blocking object seat 12 sized for a blocking object 30 of a same or similar size. In such aspects, multiple conveyance trips (e.g., wireline trips) downhole may be utilized to engage consecutive collets 10 with a desired latch 23 of a downhole structure 20 (e.g., a latch 23 of sliding sleeve 26). In such embodiments, for example, a first collet 10A can be positioned downhole and engaged with a latch 23 disposed in a downhole structure 20 (e.g., a first latch 23A of a first sliding sleeve 26A); a first zone 25A of the formation 1 can be treated with the use of pressurization of a first casing zone 21A above the first collet 10A; subsequent to the treating of the first zone 25A of the formation 1, a second collet 10B can be run downhole and engaged with a second latch 23A of a downhole structure 10 (e.g., a second sliding sleeve 26B); a second zone 25B of the formation 1 can be treated with the use of pressurization of a second casing zone 21B above the second collet 10B; and/or subsequent to the treating of the second zone 25B of the formation 1, a third collet 10C can be run downhole and engaged with a third latch 23C of a downhole structure 10 (e.g., a third sliding sleeve 26C); and so on. In such applications the first collet 10A, the second collet 10B, the third collet 10C, and so on, can be the same (e.g., can be the same size (e.g., have the same size blocking objects seats 12) and/or comprise the same keys 17) or different. Likewise, in such aspects, the first blocking object 30A, the second blocking object 30B, the third blocking object, and so on can be the same (e.g., can be the same size or type, e.g., ball, dart, etc.) or different.

A method of this disclosure can further comprise removing the collet(s) 10 (first collet 10A, second collet 10B, and/or third collet 10C, and so on) and/or blocking object(s) 30 (e.g. first blocking object 30A, second blocking object 30B, third blocking object, and so on) from the wellbore 2. Removing the collet(s) 10 from the wellbore 2 can comprise extracting the collet(s) 10 from the wellbore 2 to a surface 5, milling the collet(s) 10, consuming the collet(s) 10 (e.g., dissolving the collet(s) 10), or a combination thereof. Similarly, removing the blocking object(s) 30 from the wellbore 2 can comprise extracting/retrieving the blocking object(s) 30 from the wellbore 2 to a surface 5, milling the blocking object(s) 30, consuming or otherwise degrading the blocking object(s) 30 (e.g., dissolving the blocking object(s) 30), or a combination thereof.

Those of ordinary skill in the art will readily appreciate various benefits that may be realized by the present disclosure. Herein disclosed is a collet that can be utilized as fracturing plug. The collet 10 can be shorter, smaller, and or cheaper to fabricate than a conventional frac plug. By allowing for the use of a collet 10, for example as a short frac plug, comprising a reduced amount of material downhole than a conventional frac plug, a cost for materials can be reduced. For example, a collet 10 utilized as a frac plug according to this disclosure can have a weight of less than or equal to about 3, 2.5, 2, 1.5, or 1 pound. This can facilitate (e.g., make more rapid and/or less costly) dissolution of the collet (e.g., frac plug) subsequent utilization thereof.

A one-piece frac plug comprising the collet of this disclosure can have no moving parts (e.g., no movement of parts relative to each other, other than radial extension outward from centerline C of the collet fingers from a retained configuration to an extended/unretained configuration). The collet 10 can comprise collet fingers 13, the second ends 13" of which (e.g., keys 17) snap into a downhole structure 20 (e.g., a collar 22 on a casing joint comprising the collar 22 and two tubulars 21), which eliminates the need for slips or for complicated wedges conventionally utilized. A blocking object (e.g., a ball) 30 can be landed on the blocking object seat 12 to enhance the engagement of collet fingers 13 with latch 23 of downhole structure 20.

Collet fingers 13 comprise second ends 13" (e.g., tabs or keys 17) that fit into a profile or latch of downhole structure 20 to hold the collet 10 (e.g., frac plug) in position. The profile or latch 23 can be provided by, for example, a threaded casing joint.

The collet 10 can be set (i.e., the second ends 13" of at least the portion of the plurality of collet fingers 13 extended radially outward from centerline C of the collet 10 into latch 23 of downhole structure 20) electrically, moved out of a retaining sleeve for setting, or can be set during the firing of perforating guns, for example.

In embodiments, multiple collets 10 are utilized, each of the multiple collets 10 comprising second ends 13" having keys 17. The keys 17 of each of the multiple collets 10 can be disparate, such that the keys 17 can land in a keyed profile or latch 23 corresponding thereto, so that each latch 23 fits a unique key 17. Alternatively, the keys 17 of each of the collets 10 (and/or the corresponding latches 23 of the downhole structures with which the keys 17 engage) can be the same.

In aspects, the collet fingers 13 (e.g., the keys 17 of the second ends 13" thereof) have a pattern that fits into a pattern of profiles of latches 23. This key-and-lock approach can allow for each collet 10 to fit into a unique location within the wellbore 2.

In aspects, a collet 10 is utilized as a single piece plug. The collet 10 and/or the blocking object (e.g., a ball) 30 can be constructed from a degradable material.

Employing a plurality of collets 10 and blocking objects 30, as described hereinabove with reference to FIG. 4 can enable the use of a plurality of sliding sleeves 26. Blocking objects 30 can be deployed during the process. The resulting restrictions can be smaller, and there can be less wear on blocking object (e.g., ball) seats 12 from a wellbore fluid, for example, a proppant. For example, a first collet 10A may experience no wear, a second collet 10B may only experience wear from the fluid (e.g., proppant) in one stage of the frac, not in the early stages. Additionally, this approach allows for using dissolving materials in the collet(s) 10, because the collet(s) 10 may not experience extended exposure prior to the fracturing.

Additional Disclosure

The following are non-limiting, specific embodiments in accordance with the present disclosure:

In a first embodiment, a collet comprises: a collet ring; a plurality of collet fingers; and an object seat (e.g., ball seat), wherein the object seat comprises a surface (e.g., a curved surface) configured to interface with a correspondingly sized blocking object (e.g., a ball, dart, etc.) to form a seal therebetween, wherein each of the plurality of collet fingers has a first end and a second end, wherein the first end is proximate the collet ring, and wherein the second end of at least a portion of the plurality of collet fingers comprises a key (e.g., a tab) that is configured to engage a corresponding latch of a downhole structure.

A second embodiment can include the collet of the first embodiment, wherein the collet ring comprises the object (e.g., ball) seat.

A third embodiment can include the collet of the second embodiment, wherein the collet is configured such that, during operation, the collet ring is in an uphole position (e.g., a shorter distance along the wellbore from a surface of the wellbore) relative to the second ends of the plurality of collet fingers or such that, during operation, the collet ring is in a downhole position (e.g., a longer distance along the wellbore from a surface of the wellbore) relative to the second ends of the plurality of collet fingers.

A fourth embodiment can include the collet of any one of the first to third embodiments, wherein the object seat is formed by the keys of the at least the portion of the plurality of collet fingers.

A fifth embodiment can include the collet of any one of the first to fourth embodiments, wherein each of the plurality of collet fingers is biased to extend radially outward from a centerline of the collet.

A sixth embodiment can include the collet of the fifth embodiment further comprising a retainer configured to prevent the plurality of collet fingers from extending radially outward from the centerline of the collet when the collet is in a retained configuration and allow the plurality of collet fingers to extend radially outward from the centerline of the collet when the collet is in an unretained configuration.

A seventh embodiment can include the collet of the sixth embodiment, wherein the retainer is configured such that an application of energy to the retainer can be utilized to release the plurality of collet fingers whereby the collet assumes the unretained configuration.

An eighth embodiment can include the collet of any one of the sixth to seventh embodiments, wherein the retainer comprises a retaining sleeve positioned at least partially about the plurality of collet fingers thus preventing extension of the plurality of collet fingers radially outward from the centerline of the collet until the retaining sleeve is at least partially removed from about the plurality of collet fingers.

A ninth embodiment can include the collet of any one of the sixth to seventh embodiments, wherein the retainer comprises an electro-explosive that retains the plurality of collet fingers thus preventing extension of the plurality of collet fingers radially outward from the centerline of the collet until electricity is passed through the retainer thus resulting in degradation of the retainer and outward radial extension of the plurality of collet fingers.

A tenth embodiment can include the collet of the ninth embodiment, wherein the electro-explosive comprises a bridgewire.

An eleventh embodiment can include the collet of the tenth embodiment, wherein the bridgewire comprises aluminum clad with palladium.

A twelfth embodiment can include the collet of any one of the first to eleventh embodiments, wherein the downhole structure comprises a casing collar (e.g., at a casing joint) having the latch disposed therein or a sliding sleeve having the latch disposed therein.

A thirteenth embodiment can include the collet of any one of the first to twelfth embodiments, wherein the collet comprises metal.

A fourteenth embodiment can include the collet of any one of the first to thirteenth embodiments, wherein the collet comprises a consumable material.

A fifteenth embodiment can include the collet of the fourteenth embodiment, wherein the consumable material comprises a dissolvable material.

A sixteenth embodiment can include the collet of any one of the first to fifteenth embodiments comprising a primary layer or row comprising primary collet fingers and: a secondary layer or row comprising secondary collet fingers; and/or additional material (e.g., overlaps), wherein the secondary layer or row and/or the additional material is configured such that, upon radial outward extension of the primary collet fingers whereby the collet goes from a retained configuration to an unretained configuration, gaps formed among the primary collet fingers are at least partially or entirely filled by the secondary collet fingers and/or the additional material.

A seventeenth embodiment can include the collet of the sixteenth embodiment, wherein, in the retained configuration, the primary layer or row and the secondary layer or row are nested.

An eighteenth embodiment can include the collet of any one of the sixteenth to seventeenth embodiments, wherein the gaps are filled such that, during operation, leakage of the collet forms a continuous or substantially continuous structure around the circumference (e.g., about an outside diameter of the collet and/or inside diameter of the downhole structure), and/or flow of fluid between the object seat and the object can be substantially minimized or eliminated.

A nineteenth embodiment can include the collet of any one of the first to eighteenth embodiments, wherein the collet comprises no parts that move relative to each other, other than extension of the plurality of collet fingers radially outward from a centerline of the collet and retaining radially inward of the plurality of collet fingers toward the centerline of the collet.

A twentieth embodiment can include the collet of any one of the first to nineteenth embodiments, wherein the key has a key profile and the latch has a latch profile, wherein the key profile and the latch profile are complementary profiles.

In a twenty first embodiment, a system comprises the collet of any one of the first to twentieth embodiments; and a conveyance or deployment structure via which the collet can be positioned downhole within a wellbore.

A twenty second embodiment can include the system of the twenty first embodiment, wherein the conveyance comprises a wireline cable and a conveying tool to which the collet is attached.

A twenty third embodiment can include the system of any one of the twenty first to twenty second embodiments, comprising a plurality collets according to any one of the first to twentieth embodiments.

A twenty fourth embodiment can include the system of the twenty third embodiment comprising at least three collets.

A twenty fifth embodiment can include the system of any one of the twenty first to twenty fourth embodiments further comprising a locator (e.g., a location sensor) configured to determine when the collet is proximate the downhole structure.

A twenty sixth embodiment can include the system of the twenty fifth embodiment, wherein the locator is within a conveying tool of the conveyance or deployment structure, the conveying tool attached to and/or at least partially containing the collet.

In a twenty seventh embodiment, a system comprises the collet of any one of the first to twentieth embodiments, wherein the second ends of the collet fingers of the at least the portion of the plurality of collet fingers are coupled with the latch of the downhole structure; and the downhole structure.

A twenty eighth embodiment can include the system of the twenty seventh embodiment, wherein the downhole structure comprises a sliding sleeve or a casing collar.

A twenty ninth embodiment can include the system of any one of the twenty seventh to twenty eighth embodiments further comprising a blocking object in contact with the object seat.

A thirtieth embodiment can include the system of the twenty ninth embodiment, wherein the blocking object is positioned in the object seat such that fluid cannot flow between the blocking object and the object seat.

A thirty first embodiment can include the system of any one of the twenty ninth to thirtieth embodiments, wherein the blocking object comprises a ball, a dart, or another blocking object.

In a thirty second embodiment, a method comprises running the collet of any one of the first to twentieth embodiments downhole into a wellbore; and engaging the latch of the downhole structure with the at least the portion of the plurality of collet fingers.

A thirty third embodiment can include the method of the thirty second embodiment, wherein running the collet downhole further comprises retaining the plurality of collet fingers with a retainer, locating a position proximate the latch, and releasing the plurality of collet fingers from the retainer whereby the plurality of collet fingers extend radially outward from a centerline of the collet, and running the collet further downhole to a location of the latch, prior to engaging the latch of the downhole structure with the at least the portion of the plurality of collet fingers.

A thirty fourth embodiment can include the method of the thirty third embodiment, wherein the retainer comprises: a retaining sleeve disposed about the plurality of collet fingers, and wherein releasing the plurality of collet fingers comprises at least partially removing the retaining sleeve from about the plurality of collet fingers; or an electro-explosive, and wherein releasing the plurality of collet fingers comprises degrading the retainer via passage of electricity to the electro-explosive.

A thirty fifth embodiment can include the method of the thirty fourth embodiment, wherein the releasing of the plurality of collet fingers is initiated via a signal from a surface.

A thirty sixth embodiment can include the method of the thirty fifth embodiment, wherein the signal is transmitted to the collet wirelessly and/or via a wireline cable and/or a conveying tool utilized to convey the collet downhole.

A thirty seventh embodiment can include the method of any one of the thirty fourth to thirty sixth embodiments, wherein releasing the plurality of collet fingers comprises at least partially removing the retaining sleeve from about the plurality of collet fingers during a perforation process.

A thirty eighth embodiment can include the method of any one of the thirty second to thirty seventh embodiments, wherein running the collet downhole further comprises running the collet downhole via a wireline cable.

A thirty ninth embodiment can include the method of the thirty eighth embodiment, wherein the collet is run downhole via a conveying tool coupled to the wireline cable.

A fortieth embodiment can include the method of any one of the thirty second to thirty ninth embodiments, comprising running a plurality of collets downhole, and engaging the at least the portion of the plurality of collet fingers of each of the plurality of collets with a latch of the downhole structure.

A forty first embodiment can include the method of the fortieth embodiment, wherein the plurality of collets are run downhole via a single wireline trip.

A forty second embodiment can include the method of any one of the thirty second to forty first embodiments further comprising pumping a blocking object (e.g., a ball, dart, another blocking object) downhole and engaging the object seat with the blocking object, whereby the engaging of the object seat with the blocking object blocks flow of fluid between the blocking object and the object seat.

A forty third embodiment can include the method of the forty second embodiment further comprising applying pressure to a region of the wellbore uphole of (e.g., a shorter length along the wellbore from a surface of the wellbore than) the collet.

A forty fourth embodiment can include the method of the forty third embodiment, wherein applying pressure actuates the downhole structure.

A forty fifth embodiment can include the method of the forty fourth embodiment, wherein the downhole structure comprises a sliding sleeve, and wherein actuating the downhole structure opens the sliding sleeve whereby fluid can flow from the wellbore into a formation surrounding the wellbore.

A forty sixth embodiment can include the method of the forty fifth embodiment further comprising flowing fluid from the wellbore into the formation.

A forty seventh embodiment can include the method of the forty sixth embodiment, wherein the fluid comprises a fracturing fluid.

In a forty eighth embodiment, a method comprises: treating, via a first zone of casing adjacent a first zone of a formation surrounding a wellbore, the first zone of the formation; engaging a blocking object with a collet of any one of the first to twentieth embodiments, wherein the collet is in an extended configuration in which the plurality of collet fingers extend radially outward from a centerline of the collet and the keys of the at least the portion of the plurality of collet fingers engage a latch of a downhole structure, and wherein the collet is positioned within the wellbore above or within the first zone of the casing; and treating a second zone of the formation via a second zone of the casing above the collet.

A forty ninth embodiment can include the method of the forty eighth embodiment, wherein the collet is a first collet, the latch is a first latch, the downhole structure is a first downhole structure, and the blocking object is a first blocking object, and wherein the method further comprises: engaging a second blocking object with a second collet whereby the second blocking object contacts the object seat of the second collet, wherein the second collet is a collet according to any one of the first to twentieth embodiments, wherein the second collet is in an extended configuration in which the plurality of collet fingers extend radially outward from a centerline of the second collet and the keys of the at least the portion of the plurality of collet fingers engage a second latch of a second downhole structure, and wherein the second collet is positioned within the wellbore above or within the second zone of the casing; and treating a third zone of the formation via a third zone of the casing above the second collet; and/or optionally, engaging a third blocking object with a third collet whereby the third blocking object contacts the object seat of the third collet, wherein the third collet is a collet according to any one of the first to twentieth embodiments, wherein the third collet is in an extended configuration in which the plurality of collet fingers extend radially outward and the keys of the at least the portion of the plurality of collet fingers engage a third latch of a third downhole structure, and wherein the third collet is positioned within the wellbore above or within the third zone of the casing; and treating a fourth zone of the formation via a fourth zone of the casing above the third collet.

A fiftieth embodiment can include the method of the forty ninth embodiment further comprising positioning the first collet, the second collet, and/or the third collet downhole via the method of any one of the thirty second to thirty ninth embodiments.

A fifty first embodiment can include the method of the fiftieth embodiment: wherein the first collet, the second collet, and/or the third collet are positioned downhole via a single wireline trip; wherein the first blocking object is sized to pass through the second collet when the second collet is in the extended configuration and, when the third collet is present, the first blocking object is sized to pass through the third collet when the third collet is in the extended configuration; and when the third collet is present, wherein the second blocking object is sized to pass through the third collet when the third collet is in the extended configuration.

A fifty second embodiment can include the method of any one of the forty ninth to fifty first embodiments, wherein the keys of the at least the portion of the plurality of collet fingers of the first collet are engaged, via the first latch, with the first downhole structure, wherein the first downhole structure comprises a first sliding sleeve having the first latch disposed therein; wherein the keys of the at least the portion of the plurality of collet fingers of the second collet are engaged, via the second latch, with the second downhole structure, wherein the second downhole structure comprises a second sliding sleeve having the second latch disposed therein; and/or wherein the keys of the at least the portion of the plurality of collet fingers of the third collet are engaged, via the third latch, with the third downhole structure, wherein the third downhole structure comprises a third sliding sleeve having the third latch disposed therein.

A fifty third embodiment can include the method of the fifty second embodiment, wherein the keys of the at least the portion of the plurality of collet fingers of the first collet, the keys of the at least the portion of the plurality of collet fingers of the second collet, and/or the keys of the at least the portion of the plurality of collet fingers of the third collet are the same or different.

A fifty fourth embodiment can include the method of any one of the forty eighth to fifty third embodiments further comprising removing the collet from the wellbore.

A fifty fifth embodiment can include the method of the fifty fourth embodiment, wherein removing the collet from the wellbore comprises extracting the collet from the wellbore to a surface, milling the collet, consuming the collet (e.g., dissolving the collet), or a combination thereof.

A fifty sixth embodiment can include the method of any one of the forty eighth to fifty first embodiments, wherein treating a zone of the formation comprises pressurizing a corresponding zone of the casing (e.g., a zone of the casing adjacent the zone of the formation).

A fifty seventh embodiment can include the method of the fifty sixth embodiment, wherein treating the zone of the formation comprises fracturing or perforating the zone.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A wireline deployable collet comprising:

a collet ring;

a plurality of collet fingers, wherein each of the plurality of collet fingers is biased to extend radially outward from a centerline of the collet;

an object seat, wherein the object seat comprises a surface configured to interface with a correspondingly sized blocking object to form a seal therebetween; and a retainer configured to prevent the plurality of collet fingers from extending radially outward from the centerline of the collet when the collet is in a retained, run-in configuration during deployment in a wellbore and allow the plurality of collet fingers to extend radially outward from the centerline of the collet when the collet is in an unretained, set configuration, wherein each of the plurality of collet fingers has a first end and a second end, wherein the first end is proximate the collet ring, wherein the second end of at least a portion of the plurality of collet fingers comprises a key that is configured to engage a corresponding latch of a downhole structure when in the set configuration, and wherein the object seat is formed by the keys of the at least the portion of the plurality of collet fingers, and wherein the obiect seat is positioned uphole from the collet ring in the run- in configuration during deployment in the wellbore.

2. The collet of claim 1, wherein the retainer is configured such that an application of energy to the retainer can be utilized to release the plurality of collet fingers whereby the collet assumes the unretained configuration.

3. The collet of claim 1, wherein the retainer comprises a retaining sleeve positioned at least partially about the plurality of collet fingers thus preventing extension of the plurality of collet fingers radially outward from the centerline of the collet until the retaining sleeve is at least partially removed from about the plurality of collet fingers.

4. The collet of claim 1, wherein the retainer comprises an electro-explosive that retains the plurality of collet fingers thus preventing extension of the plurality of collet fingers radially outward from the centerline of the collet until electricity is passed through the retainer thus resulting in degradation of the retainer and outward radial extension of the plurality of collet fingers.

5. The collet of claim 1 comprising a primary layer or row comprising primary collet fingers and:

a secondary layer or row comprising secondary collet fingers; and/or additional material, wherein the secondary layer or row and/or the additional material is configured such that, upon radial outward extension of the primary collet fingers whereby the collet goes from a retained configuration to an unretained configuration, gaps formed among the primary collet fingers are at least partially or entirely filled by the secondary collet fingers and/or the additional material.

6. The collet of claim 1, wherein the collet comprises metal.

7. The collet of claim 1, wherein the collet comprises a consumable material.

8. A method comprising:

running a collet downhole into a wellbore; and wherein the collet comprises: a collet ring; a plurality of collet fingers; and an object seat, wherein the object seat comprises a surface configured to interface with a correspondingly sized blocking object to form a seal therebetween, wherein each of the plurality of collet fingers has a first end and a second end, wherein the first end is proximate the collet ring, and wherein the second end of at least a portion of the plurality of collet fingers comprises a key that is configured to engage a corresponding latch of a downhole structure, and engaging the latch of the downhole structure with the at least the portion of the plurality of collet fingers, wherein running the collet downhole further comprises retaining the plurality of collet fingers with a retainer, locating a position proximate the latch, and releasing the plurality of collet fingers from the retainer whereby the plurality of collet fingers extend radially outward from a centerline of the collet, and running the collet further downhole to a location of the latch, prior to engaging the latch of the downhole structure with the at least the portion of the plurality of collet fingers, wherein the retainer comprises:

a retaining sleeve disposed about the plurality of collet fingers, and wherein releasing the plurality of collet fingers comprises at least partially removing the retaining sleeve from about the plurality of collet fingers; or an electro-explosive, and wherein releasing the plurality of collet fingers comprises degrading the retainer via passage of electricity to the electro-explosive.

9. The method of claim 8, wherein the releasing of the plurality of collet fingers is initiated via a signal from a surface.

10. The method of claim 8 comprising running a plurality of collets downhole, and engaging the at least the portion of the plurality of collet fingers of each of the plurality of collets with a latch of the downhole structure.

11. The collet of claim 8, wherein the electro-explosive comprises a bridgewire.

12. A method comprising:

running a collet downhole into a wellbore, wherein the collet comprises: a collet ring; a plurality of collet fingers; and an object seat, wherein the object seat comprises a surface configured to interface with a correspondingly sized blocking object to form a seal therebetween, wherein each of the plurality of collet fingers has a first end and a second end, wherein the first end is proximate the collet ring, and wherein the second end of at least a portion of the plurality of collet fingers comprises a key that is configured to engage a corresponding latch of a downhole structure, and engaging the latch of the downhole structure with the at least the portion of the plurality of collet fingers, wherein running the collet downhole further comprises retaining the plurality of collet fingers with a retainer, locating a position proximate the latch, and releasing the plurality of collet fingers from the retainer whereby the plurality of collet fingers extend radially outward from a centerline of the collet, and running the collet further downhole to a location of the latch, prior to engaging the latch of the downhole structure with the at least the portion of the plurality of collet fingers, and further comprises running a plurality of collets downhole, and engaging the at least the portion of the plurality of collet fingers of each of the plurality of collets with a latch of the downhole structure, wherein the plurality of collets are run downhole via a single wireline trip.

13. A method comprising:

treating, via a first zone of casing adjacent a first zone of a formation surrounding a wellbore, the first zone of the formation;

deploying a collet in a run-in configuration into the wellbore;

transitioning the collet from the run-in configuration to a set configuration; and engaging a blocking object with a collet, wherein the collet comprises: a collet ring; a plurality of collet fingers; and an object seat, and a retainer configured to prevent the plurality of collet fingers from extending radially outward from the centerline of the collet when the collet is in a retained, run-in configuration and allow the plurality of collet fingers to extend radially outward from the centerline of the collet when the collet is in an unretained, set configuration, wherein the object seat comprises a surface configured to interface with a correspondingly sized blocking object to form a seal therebetween, wherein each of the plurality of collet fingers has a first end and a second end, wherein the first end is proximate the collet ring, wherein the second end of at least a portion of the plurality of collet fingers comprises a key that is configured to engage a corresponding latch of a downhole structure, wherein the object seat is formed by the keys of the at least the portion of the plurality of collet fingers, wherein the collet is in an extended configuration in which the plurality of collet fingers extend radially outward from a centerline of the collet and the keys of the at least the portion of the plurality of collet fingers engage a latch of a downhole structure when in the set configuration, and wherein the collet is positioned within the wellbore above or within the first zone of the casing; and treating a second zone of the formation via a second zone of the casing above the collet.

14. The method of claim 13, wherein the collet is a first collet, the latch is a first latch, the downhole structure is a first downhole structure, and the blocking object is a first blocking object, and wherein the method further comprises:

engaging a second blocking object with a second collet whereby the second blocking object contacts the object seat of the second collet, wherein the second collet is in an extended configuration in which the plurality of collet fingers extend radially outward from a centerline of the second collet and the keys of the at least the portion of the plurality of collet fingers engage a second latch of a second downhole structure, and wherein the second collet is positioned within the wellbore above or within the second zone of the casing; and treating a third zone of the formation via a third zone of the casing above the second collet; and/or optionally, engaging a third blocking object with a third collet whereby the third blocking object contacts the object seat of the third collet, wherein the third collet is in an extended configuration in which the plurality of collet fingers extend radially outward and the keys of the at least the portion of the plurality of collet fingers engage a third latch of a third downhole structure, and wherein the third collet is positioned within the wellbore above or within the third zone of the casing; and treating a fourth zone of the formation via a fourth zone of the casing above the third collet, wherein the second collet, the optional third collet, or each of the second collet and the optional third collet comprises a collet ring; a plurality of collet fingers; and an object seat, wherein the object seat comprises a surface configured to interface with a correspondingly sized blocking object to form a seal therebetween, wherein each of the plurality of collet fingers has a first end and a second end, wherein the first end is proximate the collet ring, and wherein the second end of at least a portion of the plurality of collet fingers comprises a key that is configured to engage a corresponding latch of a downhole structure.

15. A method comprising:

treating, via a first zone of casing adjacent a first zone of a formation surrounding a wellbore, the first zone of the formation;

engaging a blocking object with a collet, wherein the collet comprises: a collet ring; a plurality of collet fingers; and an object seat, wherein the object seat comprises a surface configured to interface with a correspondingly sized blocking object to form a seal therebetween, wherein each of the plurality of collet fingers has a first end and a second end, wherein the first end is proximate the collet ring, and wherein the second end of at least a portion of the plurality of collet fingers comprises a key that is configured to engage a corresponding latch of a downhole structure, wherein the collet is in an extended configuration in which the plurality of collet fingers extend radially outward from a centerline of the collet and the keys of the at least the portion of the plurality of collet fingers engage a latch of a downhole structure, and wherein the collet is positioned within the wellbore above or within the first zone of the casing; and treating a second zone of the formation via a second zone of the casing above the collet, wherein the collet is a first collet, the latch is a first latch, the downhole structure is a first downhole structure, and the blocking object is a first blocking object, engaging a second blocking object with a second collet whereby the second blocking object contacts the object seat of the second collet, wherein the second collet is in an extended configuration in which the plurality of collet fingers extend radially outward from a centerline of the second collet and the keys of the at least the portion of the plurality of collet fingers engage a second latch of a second downhole structure, and wherein the second collet is positioned within the wellbore above or within the second zone of the casing; and treating a third zone of the formation via a third zone of the casing above the second collet; and/or optionally, engaging a third blocking object with a third collet whereby the third blocking object contacts the object seat of the third collet, wherein the third collet is in an extended configuration in which the plurality of collet fingers extend radially outward and the keys of the at least the portion of the plurality of collet fingers engage a third latch of a third downhole structure, and wherein the third collet is positioned within the wellbore above or within the third zone of the casing; and treating a fourth zone of the formation via a fourth zone of the casing above the third collet, wherein the second collet, the optional third collet, or each of the second collet and the optional third collet comprises a collet ring; a plurality of collet fingers; and an object seat, wherein the object seat comprises a surface configured to interface with a correspondingly sized blocking object to form a seal therebetween, wherein each of the plurality of collet fingers has a first end and a second end, wherein the first end is proximate the collet ring, and wherein the second end of at least a portion of the plurality of collet fingers comprises a key that is configured to engage a corresponding latch of a downhole structure, wherein the first collet, the second collet, and/or the third collet are positioned downhole via a single wireline trip;

wherein the first blocking object is sized to pass through the second collet when the second collet is in the extended configuration and, when the third collet is present, the first blocking object is sized to pass through the third collet when the third collet is in the extended configuration; and when the third collet is present, wherein the second blocking object is sized to pass through the third collet when the third collet is in the extended configuration.

16. The method of claim 15, wherein the keys of the at least the portion of the plurality of collet fingers of the first collet are engaged, via the first latch, with the first downhole structure, wherein the first downhole structure comprises a first sliding sleeve having the first latch disposed therein; wherein the keys of the at least the portion of the plurality of collet fingers of the second collet are engaged, via the second latch, with the second downhole structure, wherein the second downhole structure comprises a second sliding sleeve having the second latch disposed therein; and/or wherein the keys of the at least the portion of the plurality of collet fingers of the third collet are engaged, via the third latch, with the third downhole structure, wherein the third downhole structure comprises a third sliding sleeve having the third latch disposed therein.

17. A wireline deployable collet comprising:

a collet ring;

a plurality of collet fingers, wherein each of the plurality of collet fingers is biased to extend radially outward from a centerline of the collet;

an object seat, wherein the object seat comprises a surface configured to interface with a correspondingly sized blocking object to form a seal therebetween; and a retainer configured to prevent the plurality of collet fingers from extending radially outward from the centerline of the collet when the collet is in a retained, run-in configuration and allow the plurality of collet fingers to extend radially outward from the centerline of the collet when the collet is in an unretained, set configuration, wherein each of the plurality of collet fingers has a first end and a second end, wherein the first end is proximate the collet ring, wherein the second end of at least a portion of the plurality of collet fingers comprises a key that is configured to engage a corresponding latch of a downhole structure, and wherein the retainer comprises a retaining sleeve positioned at least partially about the plurality of collet fingers between the first end and the second end, thus preventing extension of the plurality of collet fingers radially outward from the centerline of the collet during run-in until the retaining sleeve is at least partially removed from about the plurality of collet fingers.

18. A collet comprising:

a collet ring;

a plurality of collet fingers, wherein each of the plurality of collet fingers is biased to extend radially outward from a centerline of the collet;

an object seat, wherein the object seat comprises a surface configured to interface with a correspondingly sized blocking object to form a seal therebetween; and a retainer configured to prevent the plurality of collet fingers from extending radially outward from the centerline of the collet when the collet is in a retained configuration and allow the plurality of collet fingers to extend radially outward from the centerline of the collet when the collet is in an unretained configuration, wherein each of the plurality of collet fingers has a first end and a second end, wherein the first end is proximate the collet ring, wherein the second end of at least a portion of the plurality of collet fingers comprises a key that is configured to engage a corresponding latch of a downhole structure, and, wherein the retainer comprises an electro-explosive that retains the plurality of collet fingers thus preventing extension of the plurality of collet fingers radially outward from the centerline of the collet until electricity is passed through the retainer thus resulting in degradation of the retainer and outward radial extension of the plurality of collet fingers.

19. A collet comprising:

a collet ring;

a plurality of collet fingers, wherein each of the plurality of collet fingers is biased to extend radially outward from a centerline of the collet;

an object seat, wherein the object seat comprises a surface configured to interface with a correspondingly sized blocking object to form a seal therebetween; and a retainer configured to prevent the plurality of collet fingers from extending radially outward from the centerline of the collet when the collet is in a retained configuration and allow the plurality of collet fingers to extend radially outward from the centerline of the collet when the collet is in an unretained configuration, wherein each of the plurality of collet fingers has a first end and a second end, wherein the first end is proximate the collet ring, and wherein the second end of at least a portion of the plurality of collet fingers comprises a key that is configured to engage a corresponding latch of a downhole structure, and further comprising a primary layer or row comprising primary collet fingers and:

a secondary layer or row comprising secondary collet fingers; and/or additional material, wherein the secondary layer or row and/or the additional material is configured such that, upon radial outward extension of the primary collet fingers whereby the collet goes from a retained configuration to an unretained configuration, gaps formed among the primary collet fingers are at least partially or entirely filled by the secondary collet fingers and/or the additional material.

* * * * *